US009376904B2

(12) United States Patent
Lee

(10) Patent No.: US 9,376,904 B2
(45) Date of Patent: Jun. 28, 2016

(54) APPARATUS AND METHOD FOR SOLUTION MINING USING CYCLING PROCESS

(71) Applicant: KOREA INSTITUTE OF GEOSCIENCE AND MINERAL RESOURCES (KIGAM), Daejeon (KR)

(72) Inventor: Dong-kil Lee, Sejong (KR)

(73) Assignee: KOREA INSTITUTE OF GEOSCIENCE AND MINERAL RESOURCES (KIGAM), Daejeon (KR)

( * ) Notice: Subject to any disclaimer, the term of this patent is extended or adjusted under 35 U.S.C. 154(b) by 262 days.

(21) Appl. No.: 14/307,811

(22) Filed: Jun. 18, 2014

(65) Prior Publication Data

US 2015/0068753 A1 Mar. 12, 2015

(30) Foreign Application Priority Data

Sep. 9, 2013 (KR) ..... 10-2013-0107952
Sep. 9, 2013 (KR) ..... 10-2013-0107955
Nov. 19, 2013 (KR) ..... 10-2013-0140393

(51) Int. Cl.
*E21B 43/28* (2006.01)
*E21B 43/26* (2006.01)
*E21B 10/32* (2006.01)

(52) U.S. Cl.
CPC ..... *E21B 43/283* (2013.01); *E21B 10/325* (2013.01); *E21B 43/26* (2013.01)

(58) Field of Classification Search
CPC ..... E21B 43/28; E21B 43/283; E21B 43/16; E21B 43/26; E21B 33/12; E21B 10/325; E21C 35/187
See application file for complete search history.

(56) References Cited

U.S. PATENT DOCUMENTS 1,851,565 A * 3/1932 Claytor ..... E21B 43/28 175/424
4,475,771 A * 10/1984 Atwood ..... E21B 43/30 299/4

(Continued)

FOREIGN PATENT DOCUMENTS

CA 1010779 5/1977
JP 2001-082062 A 3/2001

(Continued)

OTHER PUBLICATIONS

Australian Office Action; dated May 22, 2015; Appln. No. 2014202934.

(Continued)

*Primary Examiner* — Yong-Suk (Philip) Ro
(74) *Attorney, Agent, or Firm* — Ladas & Parry LLP

(57) ABSTRACT

Provided are an apparatus and method for solution mining using cycling process in which a solvent is injected into underground useful ores to dissolve the useful ores and then collected again to obtain the useful ores. The cycling solution mining method includes a boring process for excavating the underground up to an ore deposit, a fracturing process to generate cracks in the ore deposit, an injection process for inserting a mining apparatus including an insertion rod having a pipe shape up to a lower portion of the well to inject a solvent that dissolves the useful ores into the ore deposit through the insertion rod, wherein a rotation force is applied to the solvent discharged from the insertion rod to increase a diffusion force of the solvent, and a production process for collecting the solvent, in which the useful ores are dissolved, again.

13 Claims, 9 Drawing Sheets

(56) References Cited

U.S. PATENT DOCUMENTS 4,498,706 A * 2/1985 Ilardi ..... B01D 61/44 204/537
4,625,054 A * 11/1986 Bernini ..... C07C 51/487 564/135
2003/0029617 A1* 2/2003 Brown ..... E21B 43/28 299/5
2013/0068473 A1* 3/2013 Tunget ..... E21B 41/0035 166/373
2013/0171048 A1* 7/2013 Phillip ..... E21B 43/34 423/208

FOREIGN PATENT DOCUMENTS

JP 5-214459 B2 6/2013
KR 10-1029508 B1 4/2011

OTHER PUBLICATIONS

Summary in English of the Chinese Office Action dated Feb. 3, 2016.

* cited by examiner

| Metal or Mineral | Approximate Primary Production | Dissolution Agent/Method |
|---|---|---|
| Gold | 35% | NaCN |
| Sliver | 25% | NaCN |
| Copper | 30% | $H_2SO_4$; $(NH_4)_2CO_3$ |
| Uranium | 75% | $H_2SO_4$; $(NH_4)_2CO_3$ |
| Common Salt | 50% | Water |
| Potash | 20% | Water |
| Trona | 20% | Water |
| Boron | 20% | HCI |
| Magnesium | 85% | Seawater, lake brine processing |
| Sulfur | 35% | Hot water (Melting) |
| Lithium | 100% | Lake brine processing |

FIGURE 1

APPARATUS AND METHOD FOR SOLUTION MINING USING CYCLING PROCESS

CROSS-REFERENCE TO RELATED APPLICATIONS

This U.S. non-provisional patent application claims priority under 35 U.S.C. §119 of Korean Patent Application No. 10-2013-0107952, filed on Sep. 9, 2013, Korean Patent Application No. 10-2013-0107955, filed on Sep. 9, 2013 and Korean Patent Application No. 10-2013-0140393, filed on Nov. 19, 2013, the entire contents of which are hereby incorporated by reference.

BACKGROUND OF THE INVENTION

The present invention disclosed herein relates to an apparatus for mining useful underground resources, and more particularly, to a solution mining method in which a solvent is injected into an underground ore deposit containing concentrated useful resources to dissolve the useful resources, thereby collecting the dissolved useful resources, and a solution mining apparatus using the same.

As underground resources are developed for a long time, conventional mining methods meet with difficulties in economical and technical aspects. Thus, in these latter days, a solution mining method that gets out of the conventional mining methods is being actively applied as a method for developing natural resources.

As illustrated in table of FIG. 1, although the solution mining method is first used in 1922, the solution mining method is being more actively applied at present. Presently, at least about 25% of an output of natural resources such as gold, silver, copper, uranium, sodium, magnesium, sulfur, lithium, and the like in the U.S is being developed by using the solution mining method.

According to solution mining method, a borehole is formed up to an ore deposit in which useful ores are concentrated, and a solvent is injected into the borehole to dissolve or leach the useful ores in the solvent. Then, the solvent may be collected again to produce the useful ores.

In the existing solution mining method, studies with respect to solvents, which are adequate for a kind of ores to be mined and surrounding geological environments, and a temperature of a solvent to be injected, or studies with respect to fluidity of a solvent according to surrounding environments such as porosity, permeability, and the like are being mainly conducted.

However, studies with respect to methods for improving a production rate and economic feasibility by effectively permeating and diffusing the solvent into the ore deposit are much to be desired.

SUMMARY OF THE INVENTION

The present invention provides a solution mining apparatus and method using a cycling process, which are capable of improving a production rate and economic feasibility by effectively permeating and diffusing a solvent into an ore deposit.

Embodiments of the present invention provide a cycling solution mining apparatus, which is inserted into a well by excavating the underground up to an ore deposit in which useful ores that are objects to be mined are concentrated to inject a solvent into the ore deposit, the cycling solution mining apparatus including: an insertion rod inserted into the well, the insertion rod including at least one injection pipe for injecting the solvent, a collection pipe for collecting the solvent injected into the well again, and a fluid injection pipe through which a fluid for applying a pressure is injected; a driving unit including a cylinder disposed in a lower inner portion of the insertion rod to communicate with the fluid injection pipe, a piston reciprocated within the cylinder, and a shaft fitted into an opening part that extends from a lower portion of the cylinder to a lower end surface of the insertion rod and coupled to a bottom surface of the piston; and a blade applying a rotation force to the solvent to increase a diffusion force of the solvent, the blade being connected to the shaft and coupled to the insertion rod so as to be rotatable between a posture in which the blade protrudes from the insertion rod and a posture in which the blade is inserted into the insertion rod according to the reciprocating movement of the shaft.

In some embodiments, the blade may be adjustable in rotating angle by a pressure applied to the cylinder.

In other embodiments, the driving unit may further include a spring that is fitted into the shaft and compressibly supported between the piston and the bottom surface of the cylinder.

In still other embodiments, the cycling solution mining apparatus may further include a packer for sealing a space between the insertion rod and a hollow wall of the well or a head part for blocking a borehole defined in an upper portion of the well.

In even other embodiments, the driving unit may have one end rotatably coupled to the shaft and the other end fixed to the shaft and may further include a connection bar for rotating the blade when the shaft is reciprocated.

In yet other embodiments, the blade may be inclined with respect to a cross-section of the insertion rod so that the solvent is diffused upward or downward with directivity.

In other embodiments of the present invention, a cycling solution mining method includes: a boring process for excavating the underground up to an ore deposit in which useful ores that are objects to be mined are concentrated to form a well; a fracturing process for inserting a fracturing device through the well to generate cracks in the ore deposit; an injection process for inserting a mining apparatus including an insertion rod having a pipe shape up to a lower portion of the well to inject a solvent that dissolves the useful ores into the ore deposit through the insertion rod, wherein a rotation force is applied to the solvent discharged from the insertion rod to increase a diffusion force of the solvent; and a production process for collecting the solvent, in which the useful ores are dissolved, again.

In some embodiments, a blade may be coupled to a lower portion of the insertion rod of the mining apparatus, and the blade may rotate to apply the rotation force to the solvent.

In other embodiments, the cycling solution mining method may use the cycling solution mining apparatus including the above-described components.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings:

FIG. 1 a table illustrating an ore production rate through a solution mining method in the U.S;

FIGS. 3A and 3B are cross-sectional views of a cycling solution mining apparatus according to a first embodiment, wherein FIG. 3A is a view of a state in which a blade is folded, and FIG. 3B is a view of a state in which the blade is spread;

DETAILED DESCRIPTION OF PREFERRED EMBODIMENTS

The present invention relates to an apparatus and method for mining useful ores such as gold, silver, copper, uranium, potassium, sulfur, lithium, and the like, which are buried in the underground. In the mining according to the conventional method, a mineshaft may be constructed up to an ore deposit of the underground to mine useful ores. If the ore deposit exists at a relatively shallow depth, the ground may be directly excavated from the surface of the earth without digging a separate mineshaft to mine useful ores. However, even though the economic feasibility is not secured by the conventional mining method, if target ores to be mined have solvent-soluble properties, the solution mining method may be used.

In the solution mining method according to the present invention, a well is formed up to a formation in which an ore deposit exists. Then, a solvent is injected through the borehole to dissolve useful ores to come directly from the solvent, in which the useful ores are dissolved, to the ground, thereby separating and collecting the useful ores from the solvent.

The solution mining method may be useful in a case where upper and lower formations, in which the ore deposit exists, are impermeable. This is done because the solvent in which the ores are dissolved may be carried away in the case where the upper and lower formations, in which the ore deposit exists, are permeable when the solvent in which the ores are dissolved is collected to the ground through the well.

One of important technical projects in the solution mining method is increase solubility and a dissolution rate with respect to the solvent of the useful ores. If the solubility is high, the useful ores within the solvent may increase in concentration to improve productivity and more easily separate and collect the useful ores from the solvent. Also, if the solubility is high, the ores may be dissolved by using a relatively small amount of solvent to improve economic feasibility. Also, when the dissolution rate increases, a mining time may be reduced to improve the economic feasibility.

That is, since the solubility and the dissolution rate within the solvent of the useful ores increase, the productivity and economic feasibility may significantly increase. The present invention is to physically generate a turbulent flow in the solvent, thereby improving the solubility and the dissolution rate with respect to the useful ores.

Hereinafter, a solution mining apparatus using a cycling process (hereinafter, referred to as a cycling solution mining apparatus) will be described with reference to the accompanying drawings.

Figure 3A:
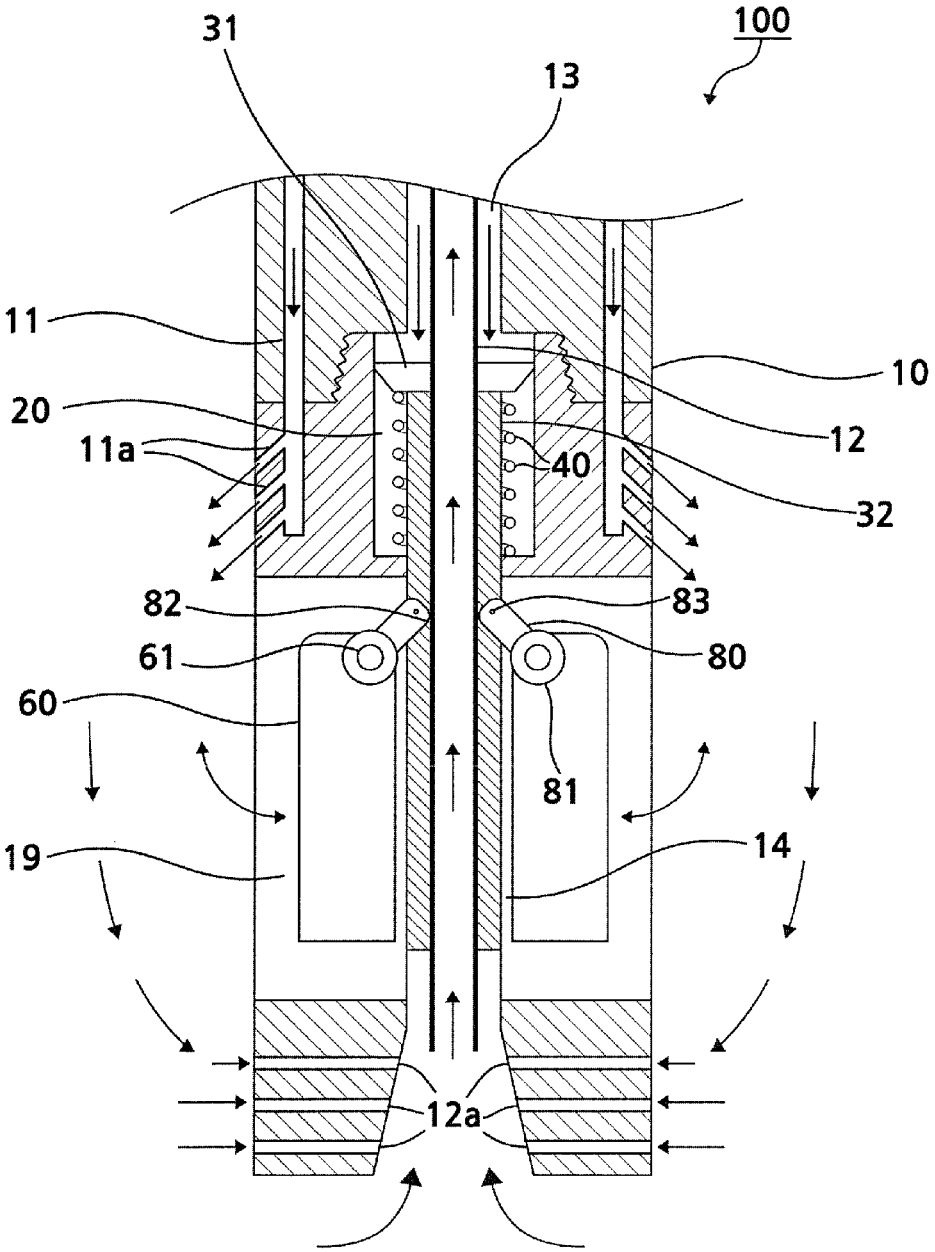
Figure 3B:
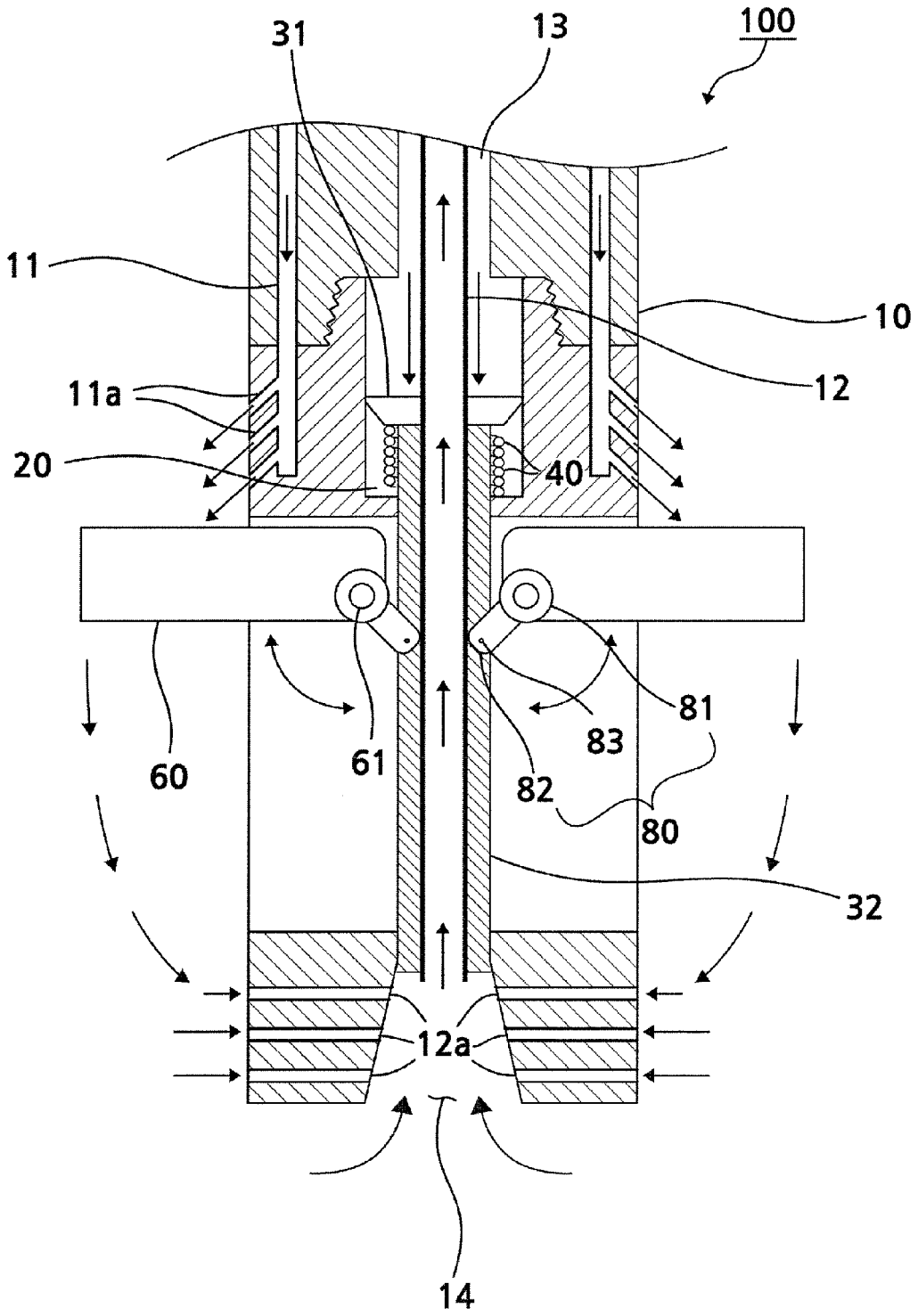
Figure 4:
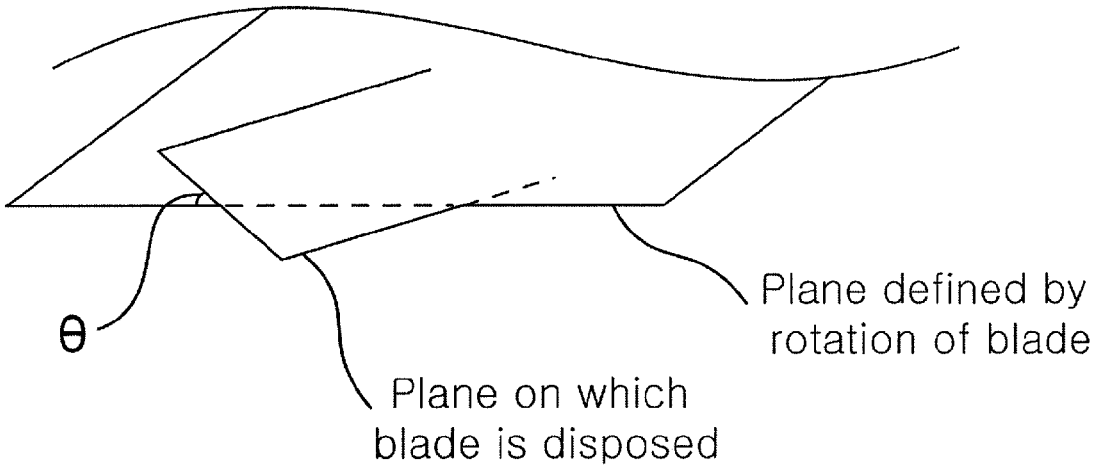
FIG. 4 is a view for explaining a plane on which a blade is disposed in another cycling solution mining apparatus according to the present invention.
Figure 5:
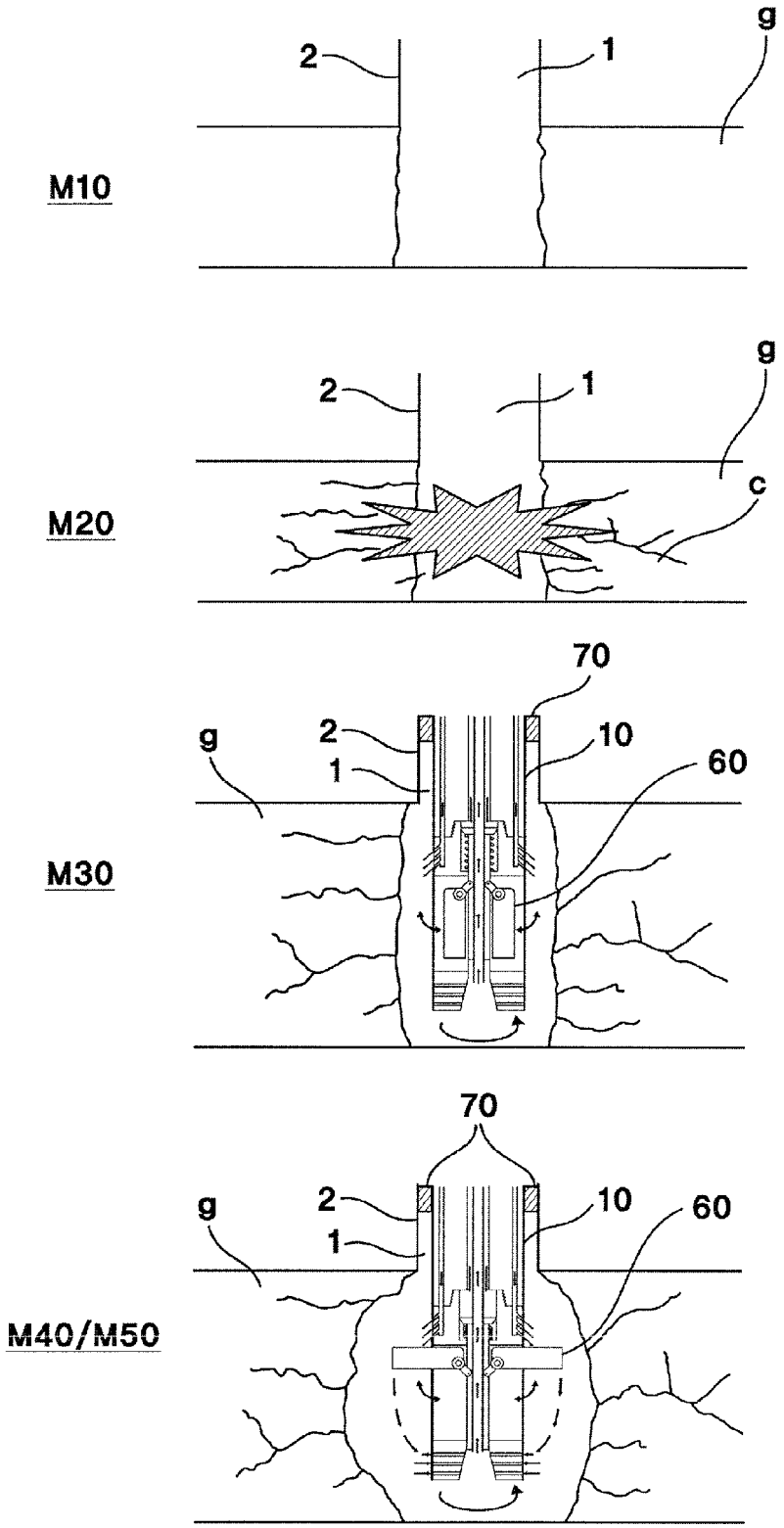
FIG. 5 is a view for explaining a solution mining method in a single well according to the first embodiment of the present invention.

FIGS. 3A and 3B are schematic views of a cycling solution mining apparatus according to a first embodiment, FIG. 4 is a view for explaining a plane on which a blade is disposed in another cycling solution mining apparatus according to the present invention, and FIG. 5 is a view for explaining a solution mining method in a single well according to the first embodiment of the present invention.

Referring to FIGS. 3A to 5, a cycling solution mining apparatus 100 according to the present invention includes an insertion rod 10, a driving unit 50, a blade 60, and a packer 70.

The insertion rod 10 may have a shape that is long in one direction and be inserted into a well 1. An injection pipe 11 and a collection pipe 12 are disposed within the insertion rod 10.

The injection pipe 11 may be connected to a solvent tank (not shown) to serve as a passage through which a solvent is injected into a lower portion of a well. A plurality of injection holes 11*a* communicating with the outside of the insertion rod 10 are defined in a lower portion of the injection pipe 11.

The collection pipe 12 may serve as a passage through the solvent in which a target ore is dissolved is collected again into an ore separation system (not shown) disposed on the ground after the solvent introduced into the well dissolves the target ore. Also, a plurality of collection holes 12*a* are defined in a lower end of the insertion rod 10. The solvent may be introduced into the collection pipe 12 through the collection holes 12*a* and an opening part 14 that is defined in a lower portion of the insertion rod 11.

In the ore separation system, the target ore and the solvent may be separated from each other through various separation processes. Then, the solvent may be injected again into the well 1 and circulated into the well 1. Although the present invention is not limited to the positions of the injection pipe and the collection pipe, the collection pipe 12 may be disposed on a central portion of the insertion rod 10, and the injection pipe 11 may be disposed on the periphery of the insertion rod 11. Also, the collection pipe 12 may have a diameter greater than that of the injection pipe 11. The reason in which the collection pipe 12 has the diameter greater than that of the injection pipe 11 and is disposed on the central portion of the insertion rod 10 is because it is preferable that the collection pipe 12 has a relatively large diameter due to ores or rocks remaining the solvent without being dissolved.

Also, in the current embodiment, a fluid injection pipe 13 for injecting a fluid for applying a pressure may be disposed within the insertion rod 10. The fluid injection pipe 13 may be connected to an external pump (not shown) to apply a pressure into a cylinder that will be described later. In the current embodiment, the fluid injection pipe 13 may surround the collection pipe 12 and be disposed in a ring shape. That is, the through hole is defined in the central portion of the insertion rod 11, and the collection pipe 12 is inserted into the through hole to define a ring-shaped space between the collection pipe 12 and the through hole, thereby serving as the fluid injection pipe 13.

Also, the packer 70 may block a space between the insertion rod 10 and a casing 2 or a hollow wall (in a case where the casing 2 is not installed) of the well 1 at the upper or middle portion of the insertion rod 10 to prevent the solvent from flowing between the insertion rod 10 and the well 1, thereby firmly coupling the insertion rod 10 to the inside of the well 1. The packer 70 may be coupled to the insertion rod 10 and formed of a contractible and expandable material. When the fluid is injected into an inflow/discharge pipe (not shown) connected to the packer 70, the packer 70 may be expanded and thus be closely attached to the hollow wall or casing 2 of the well 1 to firmly fix the insertion rod 10 to the well 1. On the contrary, when the fluid is discharged through the inflow/discharge pipe, the packer 70 may be contracted to separate the insertion rod 10 from the well 1.

Although the packer 70 generally has the contractible and expandable shape as described above, the present invention is not limited thereto. For example, the packer 70 may have a piston shape that is vertically movable along the insertion rod 10 in the state where the picker 70 is inserted into the insertion rod 10. Alternatively, the packer 70 may have a shape that blocks the space between the insertion rod 10 and the hollow wall by using concrete at the upper portion of the well 1. The packer 70 according to the present invention may have the contractible and expandable structure, the structure that blocks the space between the insertion rod 10 and the hollow wall of the well 1 by using the concrete, or a structure that seals the space between the hollow wall of the well 1 and the insertion rod 10.

The driving unit 50 for driving the blade 60 that will be described later is disposed on a lower portion of the insertion rod 10. The driving unit 50 includes a cylinder 20, a piston 31, a shaft 32, and a spring 40.

The cylinder 20 has a sealed space that is vertically defined within the insertion rod 10. A piston 31 that is vertically reciprocated within the cylinder 20 is disposed within the cylinder 20. The piston 31 may be closely attached to an inner circumference surface of the cylinder 20 to partition an inner space of the cylinder 20 into upper and lower spaces, thereby sealing and isolating the upper and lower spaces of the cylinder 20 from each other. However, since the piston 31 moves within the cylinder 20, each of the upper and lower spaces may not be fixed in volume, but have a variable space.

An upper portion of the cylinder 20 may communicate with the fluid injection pipe 13. When the fluid is introduced into the upper space through the fluid injection pipe 13, the piston 31 may be pushed downward by a pressure of the fluid.

Also, an opening part 14 that extends from a lower portion of the cylinder 20 up to a lower end surface of the insertion rod 10 is defined in the insertion rod 10. The shaft 32 fixed to a bottom surface of the piston 31 is inserted into the opening part 14. The shaft 32 may have a long shape in the same direction as the insertion rod 10 to move together with the movement of the piston 31.

The spring 40 is inserted into an upper portion of the shaft 32. The spring 32 is supported between the bottom surface of the piston 31 and the bottom surface of the cylinder 20. When the fluid is injected into the upper space of the cylinder 20 to allow the piston 31 to descend, the spring 40 is compressed. On the contrary, when the pressure applied to the upper space of the cylinder 20 is released by the discharge of the fluid, the compressed spring 40 may elastically return to allow the piston 31 to return to its original shape.

Also, as illustrated in the drawings, the collection pipe 12 is disposed to pass through the cylinder 20, the piston 31, and the shaft 40. Here, since the collection pipe 12 is not coupled to the piston 31 and the shaft 40, the collection pipe 12 may not move together with the piston 31 and the shaft 40. However, in another embodiment, the collection pipe 12 may be integrated with the piston 31 and the shaft 40.

The present invention has a technical feature in which a rotation force may be applied to the solvent injected into the ore deposit to generate the turbulent flow. For this, the blade 60 may be disposed on a lower end of the insertion rod 10 to rotate the blade 60. In the current embodiment, the blade 60 may be changed between a first posture in which the blade 60 is closely attached to the insertion rod 10 in parallel to the insertion rod 10 and a second posture in which the blade 60 protrudes from the insertion rod 10. That is, the blade 60 may be spread in the second posture to apply the rotation force to the solvent. Also, when the insertion rod 10 is inserted through the well 1, the blade 60 may be maintained in the first posture that is in the folded state.

In the current embodiment, the blade 60 may be provided in plurality on an outer circumference surface of the insertion rod 10. The blade 60 may be coupled to the insertion rod 10 by a rotation pin 61. The blade 60 is rotatably coupled to the insertion rod 10 with respect to a center of the rotation pin 60.

The driving unit 50 and the blade 60 are coupled to each other by a connection bar 80. That is, the connection bar 80 may have the other end 82 coupled to the shaft 40 of the driving unit 50. However, since the other end 82 of the connection bar 80 is coupled to the shaft 40 by using a pin 83 as a medium, the connection bar 80 may rotate when the shaft 40 is reciprocated.

As described above, the blade 60 connected to the driving unit 50 by the connection bar 80 may be maintained to a state in which the blade 60 is inserted into a receiving part 19 within the insertion rod 10 in the first posture as illustrated in FIG. 3A. When the shaft 40 descends, the connection bar 80 may rotate to allow the blade 60 to protrude outward from the insertion rod 10 as illustrated in FIG. 3B.

Here, a protruding degree or angle of the blade 60 may be determined by a descending distance of the shaft 40. Since the descending distance of the shaft 40 is determined by the pressure applied to the cylinder 20, the fluid injected into the cylinder 20 may be adjusted in pressure to adjust the protruding degree of the blade 60.

Also, a plane on which the blade 60 is disposed may be inclined with respect to a horizontal surface (or a cross-section of the insertion rod 10). In FIG. 3B, the blade 60 is disposed on a plane that is perpendicular to the cross-section of the insertion rod 10. In the case where the blade is vertically disposed, when the blade rotates, a maximum rotation force may be applied to the solvent. However, when the blade is vertically disposed, the blade may push the solvent in only a horizontal direction, but do not give the vertical directivity to the solvent. On the other hand, when the blade 60 is inclined at a predetermined angle with respect to with respect to a plane defined by the rotation of the blade, the solvent may be pressed upward or downward as illustrated in FIG. 4. That is, when the blade 60 rotates in one direction, the solvent may be pressed downward by the inclined blade. On the other hand, when the blade 60 rotates in the other direction, the solvent may be pressed upward by the blade.

Although the collection pipe 12 is fixedly disposed on the central portion of the insertion rod 10 to pass through the insides of the cylinder 20, the piston 31, and the shaft 32, and the fluid injection pipe 13 has the ring shape to surround the collection pipe 12 of the collection pipe 12 in the current embodiment, the present invention is not limited thereto. For example, the collection pipe 12 and the fluid injection pipe 13 may be variously changed in shape. That is, it may be unnecessary that the collection pipe 12 is disposed to pass through the piston 31, the shaft 32, and the cylinder 20. For example, the collection pipe 12 may be independently provided within the insertion rod 10. Similarly, the fluid injection pipe 13 may be provided in an independent passage that extends up to the cylinder 20 and is separated from the collection pipe 12.

Hereinafter, a solution mining method using the cycling solution mining apparatus according to the present invention will be described with reference to the accompanying drawings.

Figure 6:
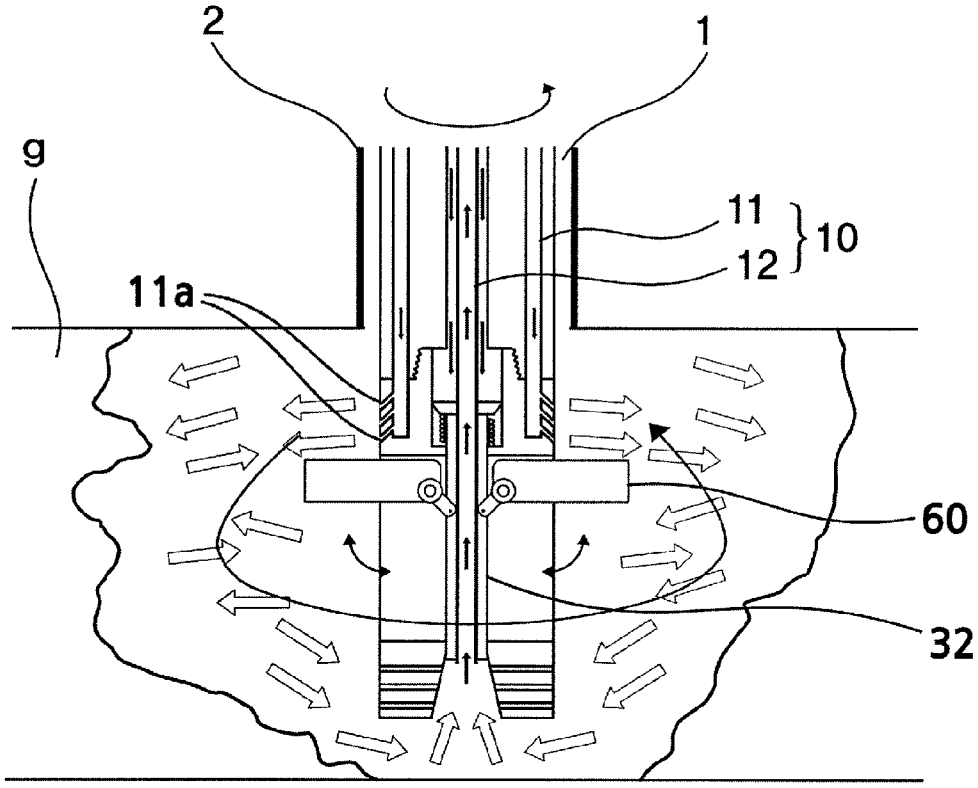
FIG. 6 is an enlarged view for explaining injection and producing processes in the solution mining method of FIG. 5.

FIG. 5 is a view for explaining a solution mining method in a single well according to the first embodiment of the present invention, and FIG. 6 is an enlarged view for explaining injection and producing processes in the solution mining method of FIG. 5.

Figure 2:
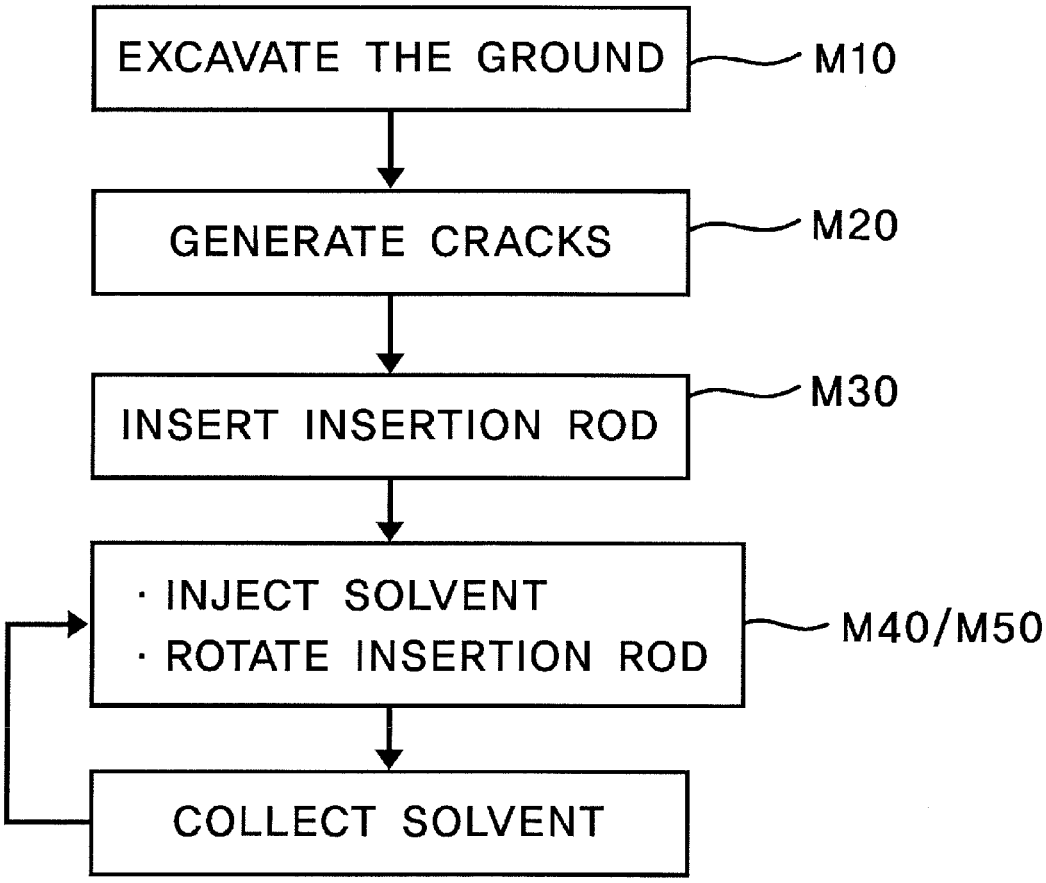
FIG. 2 is a schematic flowchart of a solution mining method using a cycling solution mining apparatus according to the present invention.

Referring to FIGS. 2, 5, and 6, the solution mining method includes a boring process M10, a fracturing process M20, an insertion rod installation process M30, an injection process M40, and a production process M50.

In the boring process M10, the ground g may be bored up to a formation in which an ore deposit, in which useful ores are concentrated, exists to form a well 1. FIGS. 5 and 6 illustrate an example of a single well method in which injection of a solvent and production of ores are performed together with each other in one well. However, the single well may not represent only one well in the ore deposit. That is, the well in which the injection of the solvent and the production of the ores are performed together with each other may be provided in plurality, and thus the production of the ores may be performed in each of the plurality of wells.

Although the well 1 is generally bored in a vertical direction, the well 1 may be inclinedly bored according to geological conditions. When the ground g is bored up to the ore deposit, a casing 2 is installed. The casing 2 is configured to firmly maintain a hollow well of the well 1. The casing 2 may be lengthily installed up to an impermeable region that is formed in an upper portion of the formation in which the ore deposit exists. Alternatively, the casing 2 may be inserted up to an upper or middle portion or of the well 1.

When the boring process M10 is completed, the fracturing process M20 is performed. In the fracturing process M20, cracks c are formed in the formation in which the ore deposit exists (i.e., the formation is fractured) to allow the solvent to flow into the formation. The cracks c may be formed through various methods. In general, the cracks c may be formed through a hydraulic fracturing method. That is, a fracturing device may be inserted into the well 1, and a packer may be installed on each of upper and lower portions of a region (the formation in which the ore deposit exists) to be cracked to seal the upper and lower portions of the region. Then, a high hydraulic pressure may be applied to the sealed region to form cracks 2 in the formation. When the cracks are completely formed, the inflated packer closely attached to a hollow wall may be contracted to demolish the fracturing device from the well 1.

Here, a water jet penetration method or blasting penetration method except for the hydraulic fracturing method may be performed in the fracturing process M20. Alternatively, the cracks c may be formed in the hollow wall of the well through a cooling method using liquid nitrogen, which is developed in recent years.

After the fracturing process M20, the insertion rod installation process M30 in which the solution mining apparatus according to the present invention is inserted and installed into the well 1 may be performed so as to inject the solvent. As described above, in the insertion rod installation process M30, the cycling solution mining apparatus 100 according to the present invention is inserted into the well 1. When the cycling solution mining apparatus 100 is inserted, a blade 60 may be disposed in a first posture to prevent the blade 60 from interfering with the hollow wall of the well 1 or being fractionized with the hollow wall. When an insertion rod 10 reaches a desired position, the insertion rod 10 is fixed to the wall 1 by using the packer 70.

As described above, after the insertion rod 10 is installed, the injection process M40 for injecting the solvent and the production process M50 for collecting the solvent in which the ores are dissolved may be performed. For convenience of descriptions, although the injection process M40 and the production process M50 are separately described, the injection process M40 and the production process M50 may be performed together with each other.

First, a liquid solvent may be injected at a high pressure through an injection pipe 11 of the insertion rod 10. The solvent may reach the formation, in which the ore deposit exists, along the injection pipe 11 and then be permeated into the cracks s formed in the fracturing process M20 to dissolve the useful ores within the ore deposit.

When the injection of the solvent starts, the dissolution of the useful ores may start. Thus, it may be difficult to rotate the blade 60 disposed on the insertion rod 10. If the blade 60 has a diameter less than an inner diameter of the well 1, the blade may rotate just when the solvent is injected.

Also, when the solvent is injected to dissolve the useful ores from the surroundings of the well 1, the blade 60 may rotate to generate a turbulent flow in the solvent, thereby increasing a diffusion force of the solvent. When the lower portion of the well 1 is expanded, the blade may gradually increase in protruding angle to increase the diffusion force of the solvent.

When the solvent is continuously injected, the solvent in which the ores are dissolved may be discharged to the ground through the collection pipe 12. Then, in the ground, the solid rocks mixed with the solvent may be separated by using an ore separation system. After the useful ores are separated from the solvent, the solvent may be injected again and circulated into the well 1.

Since the solvent is introduced into the formation in which the ore deposit exists, and then the turbulent flow is generated in the solvent by the blade 60, the solvent may be easily permeated into the cracks c formed in the formation to increase a useful ore dissolving rate. Since the cracks c are more magnified while the ores are dissolved, the useful ore dissolving rate may gradually increase to increase a production rate. Also, since the dissolving rate increases, a concentration of the useful ores within the solvent may increase. Thus, the solvent and the useful ores may be easily separated from each other at the ground. According to the present invention, the rotation force and the turbulent flow may be applied to the solvent to improve a penetration force of the solvent, thereby improving the useful ore dissolving rate and production rate. Also, since the concentration of the ores within the solvent increases, the solvent and the ores may be easily separated from each other.

Although the mining apparatus used in the single well is described in the current embodiment, the present invention is not limited thereto. For example, the mining apparatus may be applied to multi wells as described in a second embodiment of FIGS. 7 to 9.

Figure 7:
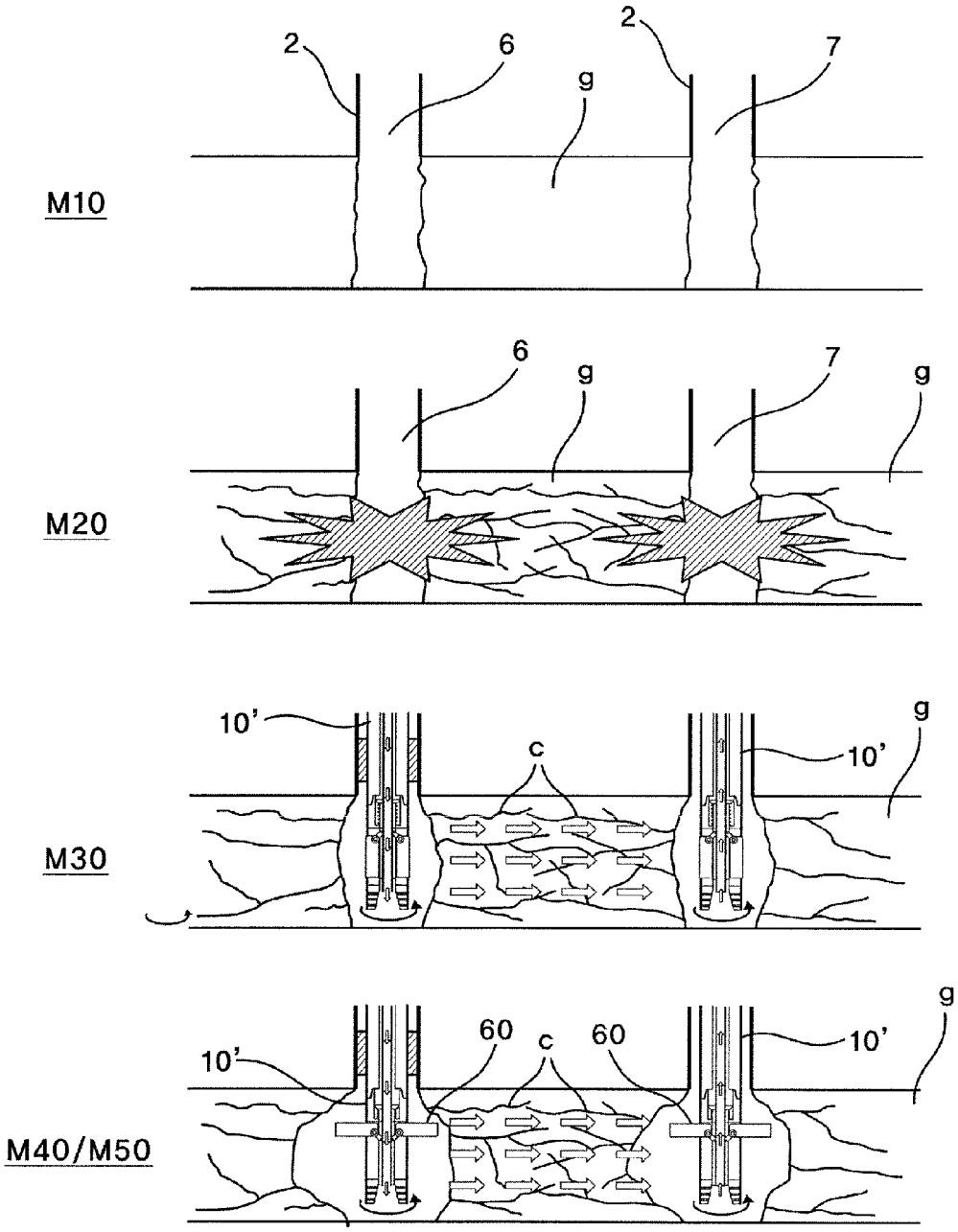
FIG. 7 is a view for explaining the whole process in the solution mining method applied to multi wells according to a second embodiment of the present invention.
Figure 8:
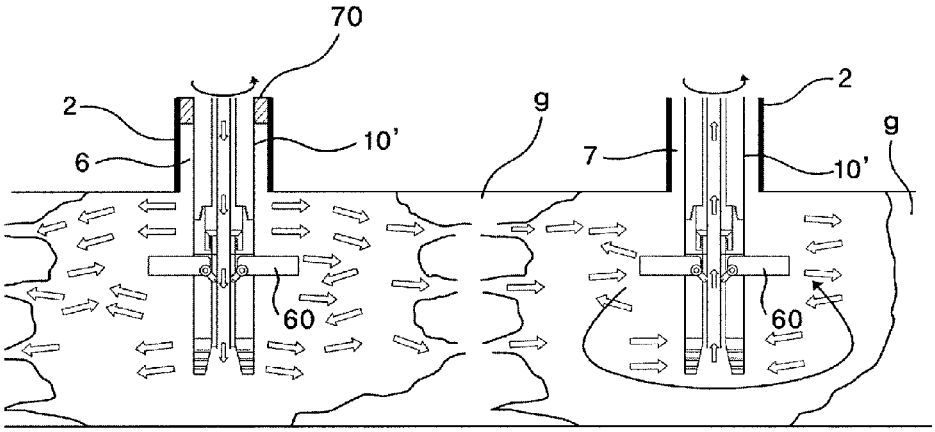
FIG. 8 is a view for explaining a producing process in the solution mining method applied to the multi wells of FIG. 7 according to the second embodiment of the present invention.
Figure 9:
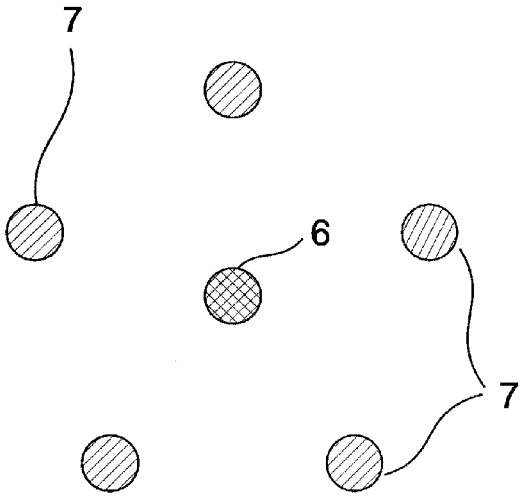
FIG. 9 is a view for explaining an arrangement state of the multi wells of FIG. 7 according to the second embodiment of the present invention.

FIGS. 7 and 8 are views for explaining a solution mining method applied to multi wells by using the cycling solution mining apparatus according to the present invention, wherein FIG. 7 is a view for explaining the whole process in the solution mining method applied to the multi wells according to a second embodiment of the present invention, and FIG. 8 is a view for explaining a producing process in the solution mining method using the multi wells of FIG. 7 according to the second embodiment of the present invention. FIG. 9 is a view for explaining an arrangement state of the multi wells of FIG. 7 according to the second embodiment of the present invention.

Referring to FIGS. 7 to 9, multi walls are formed in the second embodiment. At least one of the multi walls may be used as an injection wall 6 for injecting a solvent, and the rest wells may be used as a production wall 7 for collecting the solvent in which ores are dissolved. As illustrated in FIG. 8, the plurality of production wells 7 may surround the injection well 6.

The second embodiment may be completely equal to the first embodiment in that the wells 6 and 7 are formed, a casing 2 is installed, and cracks c are formed in a formation through a fracturing process. However, the blade 60 may be installed in only the injection well 6. Alternatively, the blade 60 may be installed in all of the injection well 6 and the production well 7. Also, unlike the first embodiment, a collection pipe 12 may be closed or may not be formed in an insertion rod 10' installed in the injection well 6 and the production well 7. Also, the injection pipe may be closed or may not be formed in the production well 7. That is, only the collection pipe may operate.

That is, the solvent may be injected only through the injection pipe in the insertion rod that is installed in the injection well 6, and the solvent in which the ores are dissolved may be pumped and collected through the insertion rod installed in the production well 7. Particularly, since it is unnecessary to provide the blade or driving unit in the insertion rod installed in the production well 7, an insertion rod having a simple pipe shape may be installed.

In the case where the multi wells are used, when a rotation force is applied to the solvent in the production well 7 by using the blade, like the single well, a turbulent flow may be generated in the solvent to increase a diffusion rate of the solvent within the formation, thereby increasing a useful ore dissolving rate. In the single well, the solvent may be collected again to its original position after the useful ores are dissolved in the solvent and then pumped. In the multi wells, the solvent may be discharged through the production well after the solvent dissolves the ores while flowing in one direction. Thus, the production rate may be significantly improved.

As described above, the blade may be installed on a lower end of the insertion rod. Then, the blade may rotate to generate the turbulent flow in the solvent. The solvent in which the turbulent flow is generated may be quickly permeated into the cracks formed in the formation to magnify the cracks while dissolving the ores. Thus, a contact area between the solvent and the useful area may be widened by the magnified cracks to increase the ore dissolving rate and production rate.

Also, according to the present invention, the ore dissolving rate may increase to increase the useful ore production rate. Also, since the dissolving rate increases, an amount of ores dissolved in the same amount of solvent may increase to increase concentrations of the ores within the solvent when compared to that of the solution mining method according to the related art. Therefore, the useful ores may be easily separated and collected.

In addition, while the rotation force is applied to the solvent, ultrasonic waves or high frequency may be applied to the solvent to promote the permeation of the solvent into the formation.

According to the present invention, the blade may be installed on the lower end of the insertion rod. Then, the blade may rotate to generate the turbulent flow in the solvent. The solvent in which the turbulent flow is generated may be quickly permeated into the cracks formed in the formation to magnify the cracks while dissolving the ores. Thus, the contact area between the solvent and the useful area may be widened by the magnified cracks to increase the ore dissolving rate and production rate.

According to the cycling solution mining apparatus and method, the ore dissolving rate may increase to increase the useful ore production rate. Also, since the dissolving rate increases, an amount of ores dissolved in the same amount of solvent may increase to increase concentrations of the ores within the solvent when compared to that of the solution mining method according to the related art. Therefore, the useful ores may be easily separated and collected.

Also, according to the present invention, the protruding degree of the blade, i.e., the rotating angle of the blade may be adjusted to adjust a rotating width of the blade according to the expanded degree of the borehole (i.e., the well) while the mining process is performed.

The description of the present invention is intended to be illustrative, and those with ordinary skill in the technical field of the present invention pertains will be understood that the present invention can be carried out in other specific forms without changing the technical idea or essential features. Hence, the real protective scope of the present invention shall be determined by the technical scope of the accompanying claims.

What is claimed is:

1. A cycling solution mining apparatus, which is inserted into a well by excavating the underground up to an ore deposit in which useful ores that are objects to be mined are concentrated to inject a solvent into the ore deposit, the cycling solution mining apparatus comprising:

an insertion rod inserted into the well, the insertion rod comprising at least one injection pipe for injecting the solvent, a collection pipe for collecting the solvent injected into the well again, and a fluid injection pipe through which a fluid for applying a pressure is injected;

a driving unit comprising a cylinder disposed in a lower inner portion of the insertion rod to communicate with the fluid injection pipe, a piston reciprocated within the cylinder, and a shaft fitted into an opening part that extends from a lower portion of the cylinder to a lower end surface of the insertion rod and coupled to a bottom surface of the piston; and a blade applying a rotation force to the solvent to increase a diffusion force of the solvent, the blade being connected to the shaft and coupled to the insertion rod so as to be rotatable between a posture in which the blade protrudes from the insertion rod and a posture in which the blade is inserted into the insertion rod according to the reciprocating movement of the shaft.

2. The cycling solution mining apparatus of claim 1, wherein the driving unit further comprises a spring that is fitted into the shaft and compressibly supported between the piston and the bottom surface of the cylinder.

3. The cycling solution mining apparatus of claim 1, further comprising a packer for sealing a space between the insertion rod and a hollow wall of the well.

4. The cycling solution mining apparatus of claim 1, wherein the driving unit has one end rotatably coupled to the shaft and the other end fixed to the shaft and further comprises a connection bar for rotating the blade when the shaft is reciprocated.

5. The cycling solution mining apparatus of claim 1, wherein the blade is adjustable in rotating angle by a pressure applied to the cylinder.

6. The cycling solution mining apparatus of claim 1, wherein the blade is inclined with respect to a cross-section of the insertion rod so that the solvent is diffused upward or downward with directivity.

7. A cycling solution mining method comprising:

a boring process for excavating the underground up to an ore deposit in which useful ores that are objects to be mined are concentrated to form a well;

a fracturing process for inserting a fracturing device through the well to generate cracks in the ore deposit;

an injection process for inserting a mining apparatus comprising an insertion rod having a pipe shape up to a lower portion of the well to inject a solvent that dissolves the useful ores into the ore deposit through the insertion rod, wherein a rotation force is applied to the solvent discharged from the insertion rod to increase a diffusion force of the solvent; and a production process for collecting the solvent, in which the useful ores are dissolved, again.

8. The cycling solution mining method of claim 7, wherein a blade is coupled to a lower portion of the insertion rod of the mining apparatus, and the blade rotates to apply the rotation force to the solvent.

9. The cycling solution mining method of claim 7, wherein the mining apparatus comprises:

an insertion rod inserted into the well, the insertion rod comprising at least one injection pipe for injecting the solvent, a collection pipe for collecting the solvent injected into the well again, and a fluid injection pipe through which a fluid for applying a pressure is injected;

a driving unit comprising a cylinder disposed in a lower inner portion of the insertion rod to communicate with the fluid injection pipe, a piston reciprocated within the cylinder, and a shaft fitted into an opening part that extends from a lower portion of the cylinder to a lower end surface of the insertion rod and coupled to a bottom surface of the piston; and a blade applying a rotation force to the solvent to increase a diffusion force of the solvent, the blade being connected to the shaft and coupled to the insertion rod so as to be rotatable between a posture in which the blade protrudes from the insertion rod and a posture in which the blade is inserted into the insertion rod according to the reciprocating movement of the shaft.

10. The cycling solution mining method of claim 9, wherein the driving unit further comprises a spring that is fitted into the shaft and compressibly supported between the piston and the bottom surface of the cylinder.

11. The cycling solution mining method of claim 9, wherein the mining apparatus further comprises a packer for sealing a space between the insertion rod and a hollow wall of the well.

12. The cycling solution mining method of claim 9, wherein the driving unit has one end rotatably coupled to the shaft and the other end fixed to the shaft and further comprises a connection bar for rotating the blade when the shaft is reciprocated.

13. The cycling solution mining method of claim 9, wherein the blade is adjustable in rotating angle by a pressure applied to the cylinder, and the blade is inclined with respect to a cross-section of the insertion rod so that the solvent is diffused upward or downward with directivity.

* * * * *